US005646593A

United States Patent [19]

Hughes et al.

[11] Patent Number: 5,646,593

[45] Date of Patent: Jul. 8, 1997

[54] CHILD PROXIMITY DETECTOR

[75] Inventors: Michael Hughes, Wolverhampton; Ian Clarke, Walsall, both of United Kingdom; William E. Hewlett, Pasadena, Calif.

[73] Assignee: Hewlett Electronics, Pasadena, Calif.

[21] Appl. No.: 429,142

[22] Filed: Apr. 26, 1995

Related U.S. Application Data

[63] Continuation of Ser. No. 382,692, Feb. 2, 1995, abandoned.

[51] Int. Cl.[6] ..... G08B 23/00

[52] U.S. Cl. ..... 340/573; 340/539; 340/568; 340/571; 340/572; 340/825.36

[58] Field of Search ..... 340/573, 539, 340/505, 572, 531, 534, 571, 568, 540, 825.36

[56] References Cited

U.S. PATENT DOCUMENTS

| | | | |
|---|---|---|---|
| 4,523,184 | 6/1985 | Abel | 340/539 |
| 4,593,273 | 6/1986 | Narcisse | 340/539 |
| 4,598,272 | 7/1986 | Cox | 340/539 |
| 4,777,478 | 10/1988 | Hirsch et al. | 340/573 |
| 4,792,796 | 12/1988 | Bradshaw et al. | 340/539 |
| 4,813,025 | 3/1989 | Rowland et al. | 367/6 |
| 5,086,290 | 2/1992 | Murray et al. | 340/539 |
| 5,115,223 | 5/1992 | Moody | 340/573 |
| 5,196,825 | 3/1993 | Young | 340/539 |
| 5,218,344 | 6/1993 | Ricketts | 340/573 |
| 5,223,815 | 6/1993 | Rosenthal et al | 340/539 |
| 5,245,314 | 9/1993 | Kah, Jr. | 340/539 |
| 5,289,163 | 2/1994 | Perez et al. | 340/539 |
| 5,298,883 | 3/1994 | Pilney et al. | 340/573 |

*Primary Examiner*—Thomas Mullen
*Assistant Examiner*—Benjamin C. Lee
*Attorney, Agent, or Firm*—Fish & Richardson P.C.

[57] ABSTRACT

A child proximity detection unit includes two transceivers which communicate messages with one another. Only a properly authorized parent can attend a message to the child unit. However, a properly authorized parent can authorize another parent to adopt a child unit.

1 Claim, 8 Drawing Sheets

PARENT
CHILD

POLL CHILD 1 BY SENDING MESSAGE
100
RECEIVE MESSAGE
402
TIME EXPIRED ?
401
Y
ALARM
N
COMPARE MESSAGE FIELDS 0 & 1 WITH MEMORY
404
PROPER ?
406
Y
N
????
N
CARRIER DETECT ?
408
N
ERROR ++
412
ERROR ? N ?
414
N
N
SEND MESSAGE TO PARENT
410
RECEIVE MESSAGE
420
Y
WAIT
415
ALARM
416
PROPER ?
422
N
Y
ERROR ++
426
ERROR ? X
428
N
NEXT POLL
424
Y
ALARM
SEND MESSAGE

CHILD PROXIMITY DETECTOR

This is a continuation of application Ser. No. 08/382,692, filed Feb. 2, 1995, abandoned upon the filing hereof.

FIELD OF THE INVENTION

The present invention defines a child proximity detector which produces an alarm when a child is a predetermined distance from the parent. More specifically, the present invention defines an advanced system of detecting that a child has not strayed farther than a predetermined distance from its parent, using two intelligent units which each communicate with the other.

BACKGROUND AND SUMMARY OF THE INVENTION

Child abductions have increased markedly in recent years. The search for missing children has made its way to television, on-line services, and various forms of advertising. Demand for deterrents against such abductions have increased.

The most common form of abduction deterrent has been a child alarm. Most child alarms, however, operate as a radio beacon detector. Typically, a child unit sends out carrier pulses on a regular interval which are received by a parent unit. When the parent unit stops receiving the pulses, an alarm condition is established. It is very easy to fool this system: any other pulse on the same carrier frequency will prevent the parent unit from alarming.

Another type of child alarm is similar to the remote activating/deactivating device for car alarm systems. The parent has a transmitter (key fob) that when pressed sends out an encoded radio signal. A loud siren is activated when this signal is detected by the child unit. This type of device is typically classified as a child locator rather than a proximity alarm. Its major drawback is that once the parent and child are out of range of one another, an alarm cannot be triggered.

Moreover, only the child unit alarms. The would-be abductor could physically muffle this alarm, since the parent gets no indication of same.

Other such devices are known, but all suffer from similar drawbacks.

It is therefore an object of the present invention to provide a system which provides an intelligent means of determining child proximity, and in which both a child unit and a parent unit communicate information to one another so that both provide alarm indications at the proper times, and to prevent either unit from being fooled by a decoy.

BRIEF DESCRIPTION OF THE DRAWINGS

These and other aspects of the invention will now be described in detail with reference to the accompanying drawings, wherein.

DESCRIPTION OF THE PREFERRED EMBODIMENTS

Figure 1:
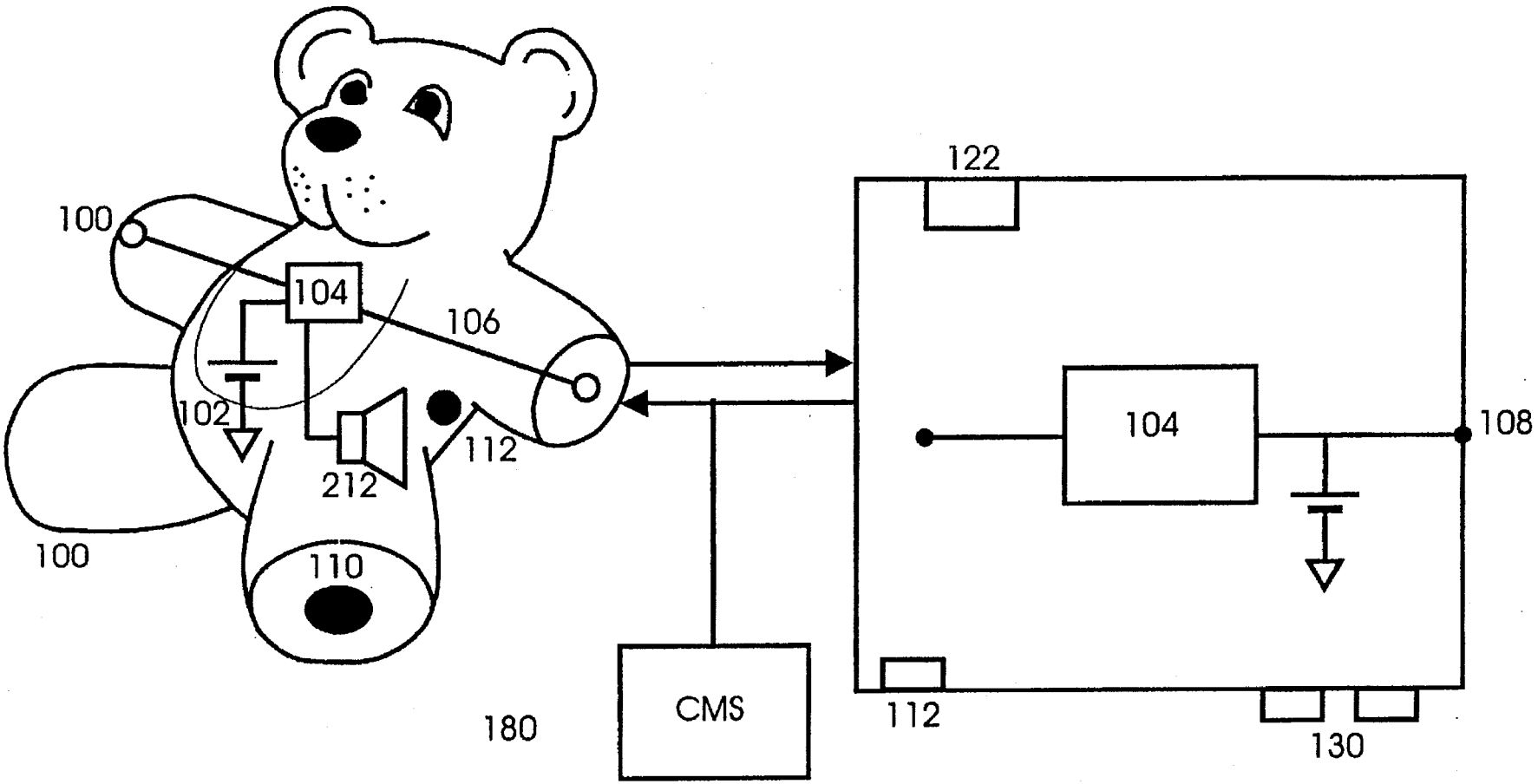
FIG. 1 shows the parent and child units of the present invention.

The preferred embodiment operates as follows. There is a parent unit (herein simply parent) and a child unit (herein simply child). Each has a radio transceiver which allows them to talk and listen to each other. The radio transceivers are controlled by a "pic" microcontroller powered by a MAX 619 IC, which provides a 5 v supply voltage to power them from a 1 or 2 cell battery power source.

The parent unit has a list of 8 child names which can be made inactive by setting the most significant bit "msb" to a 1, or active by setting it to a 0. Our system uses an 8-bit number for each child name allowing up to 127 active child names.

The parent has it's own name based on an 8-bit number where the msb is used to denote that it is a parent name. When the two units are plugged together using the umbilical cord, the parent can activate the child's name and so toggle the child on or off. This happens after the two units complete a successful dialog of saying who they are to each other.

When the units are on, the parent will, every 0.6 seconds, transmit a message containing a preamble, a unique start bit, and then parent name, child name, and a control byte. The parent waits a preset time for the child to reply. When the child sees that its parent has transmitted and sent its own name, it will then reply with a similar message to the parent. Because the parent names and child names are numbers, any other child units will know that the message is not for them and so will not reply. This allows families in the area not to interfere, and that other children from the same parent know that it is their parent but it is not them who are being asked to reply and so they can wait for their turn to reply.

Once the parent has received a correct reply from its first child it can then search for another active child name in its list and poll that one. Once the parent has spoken to all its children the parent unit then sleeps to conserve power. After the child has spoken to its parent, it too will sleep. The pic wakes up from this low power sleep responsive to a watchdog timer interrupt.

At the start of the transmissions all units check that no other units in the area are talking and do not transmit to avoid interference. Once it is detected that the carrier is free, the unit can then transmit if it needs to. If, however, the parent detects that the carrier is still not free after a predetermined delay, it will transmit in an attempt to prevent jamming.

There are various time delays during all parts of the code which if exceeded will put the unit in alarm condition. One example is from waiting too long for the carrier to be free and not receiving a correct reply in time.

To prevent false alarms during operation when data reception might become intermittent and a few transactions may be missed, the software checks for a preset number of correct receptions before alarming.

If the parent does not hear its child replying within a preset time, it does not go on to the next child, but will start transmitting at a faster rate to try to contact the child. As soon as the child is back in range, it carries on with normal operation. If there are any other children on the family when an alarm condition occurs, they will also be receiving the parent's transmissions. If they see that it is their parent who is transmitting, but not to them, they can then check to see if the "alarm" bit is set in the control byte. If this is so, they keep listening but do not go into alarm so long as they can still detect their parent.

During the christening process, the parent controls the flow of data at all times using the "clock" line. Data is sent in the form of a command followed by data. The direction of data flow is done by units "handing over" the data line after certain transactions are completed with each unit configuring its data line pin as the required input or output. The rate at which data is transferred is set by the rate at which the parent unit toggles the clock line.

FIG. 1 shows the basic layout of the preferred embodiment of the present invention. Child unit 100 is shaped like a child toy, shown in FIG. 1 as a teddy bear. The teddy bear housing contains a battery 102, circuit board 104, and transceiving antenna 106 and buzzer 212. Battery 102 is rechargeable via recharging port 108 which receives DC power to recharge battery 102.

Parent unit 120 has the same circuit board 104, battery 102 and other components therein.

Both units include connection elements enabling connection to another unit. These connections are preferably modular phone jacks: modular phone jack 110 being shown on the child unit, and phone jack 112 being shown on the parent unit. These modular phone jacks are connected by a short length of detachable telephone wire in order to effect the programming described herein. Of course, any other kind of connector could be used, including RCA type connectors, banana plugs, or any other wire connecting structure.

The parent unit has an ID number referred to herein as the parent id. When a child unit is first started, however, it has no ID number. The child unit can be connected to the parent unit through the modular phone jacks, and the communication which occurs therebetween assigns the child unit a number and communicates the address of the parent unit 120 to the child unit. After this initial programming, the child unit can only communicate with parent unit 120 or a designee thereof. This connection is also used to power up and power down the child unit 100, which has no on/off switch thereon.

Child unit 100 also includes straps 112 therein. These straps are intended to hold a strap unit which secures the unit 100 to a child. It is important that the unit be attached to the child in a way that it cannot be easily removed. High strength hard-to-remove materials are preferably used. One preferred material is structure which is laced into the laces of the shoes. Other materials, including tie-wraps or the like which cannot be removed are preferably used.

Importantly, the child unit itself has no means of turning off. Therefore, a would-be abductor cannot simply disable the unit. Only a properly-authorized parent unit can turn off the child unit.

Figure 2:
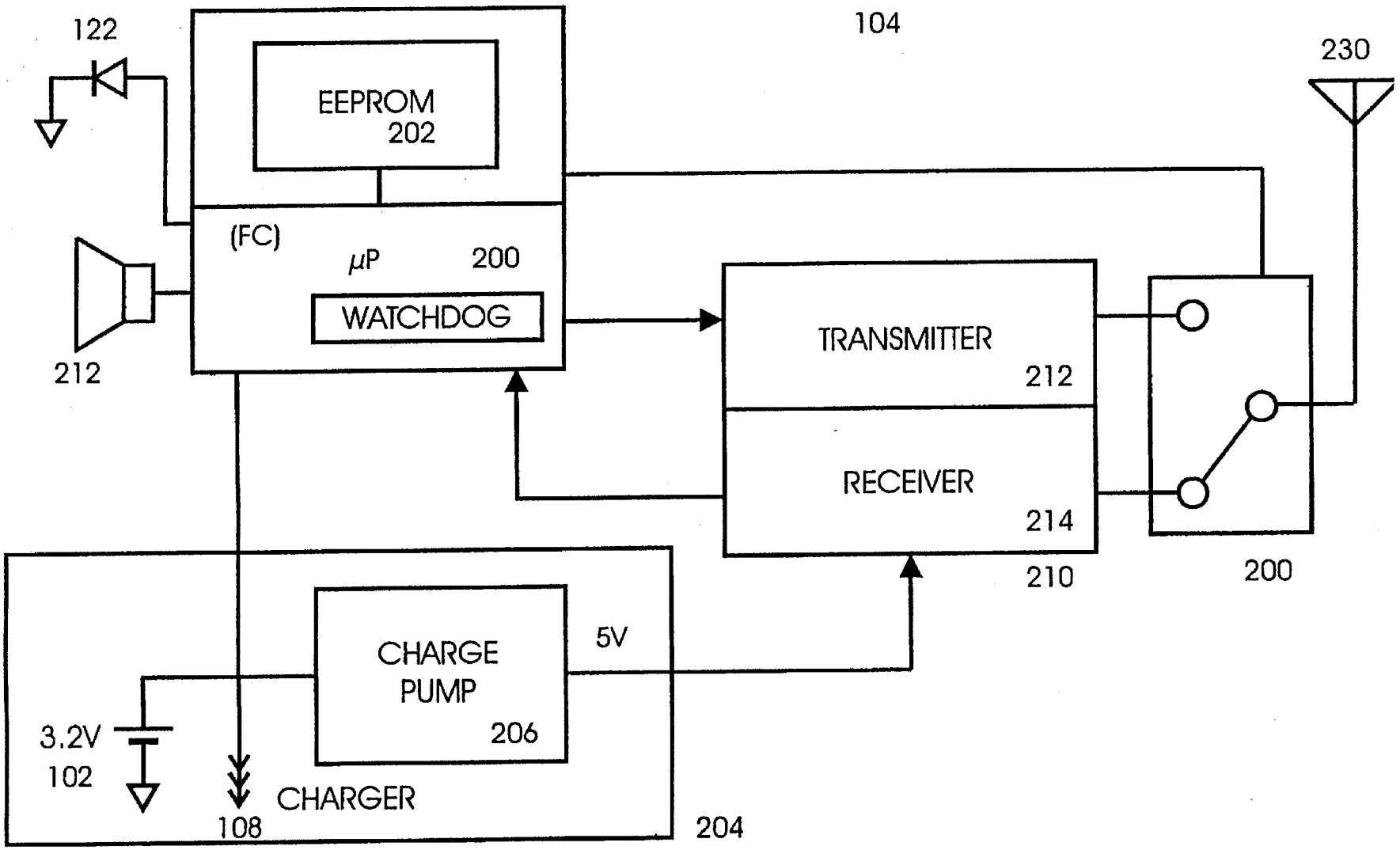
FIG. 2 shows a block diagram of the electronics of the present invention.

FIG. 2 shows a block diagram of circuit board 104. The circuit boards in both the parent and child unit are substantially identical, with the only difference being the programming of the processor. The system uses a microprocessor 200 to carry out most of its processing operations. Processor 200 is preferably a "PIC" type processor which includes various controlling circuitry and memories thereon. The PIC processor 200 also includes an EEPROM which is electrically alterable to store information therein according to the running computer program. This allows non-volatile information to be stored therein.

Power supply 204 includes battery 102 and charge port 108. The 3.2 volt battery may not be sufficient to operate the transceiver module, and so preferably a charge pump 206 is also used. The preferred charge pump is Maxim semiconductor item no. 619, which steps up the voltage from 3.2 to 5 volts.

Transceiver 210 is a half-duplex device which conceptually includes a transmitter 212 and a receiver 214. The preferred module used is a radiometric UHF data transmitter model no. BiM-418-F. This device transmits at 418 MHz, and 0.252 mw of power.

The transmitter 212 and receiver 214 are respectively connected to contacts of a transfer switch 220. Transfer switch 220 is controlled by the microprocessor program as discussed herein and controls whether the unit is transmitting or receiving. In the position shown in element 220, of course, the unit is receiving.

Reception is carried out by antenna 230, which is preferably a length of wire connected to part of the circuit board, or a land on the circuit board. This land or length of wire is trimmed to adjust range.

All messages transmitted according to the present invention are of a form shown in FIG. 3 and will be discussed further herein. This message format includes a preamble, followed by a unique start bit, and then three blocks of information: a parent id block portion 0, a child ID block portion 1, and a command section portion 2. Presently each of these sections is 7 bits, but it should be understood that each could be of any desired length.

Figure 4:
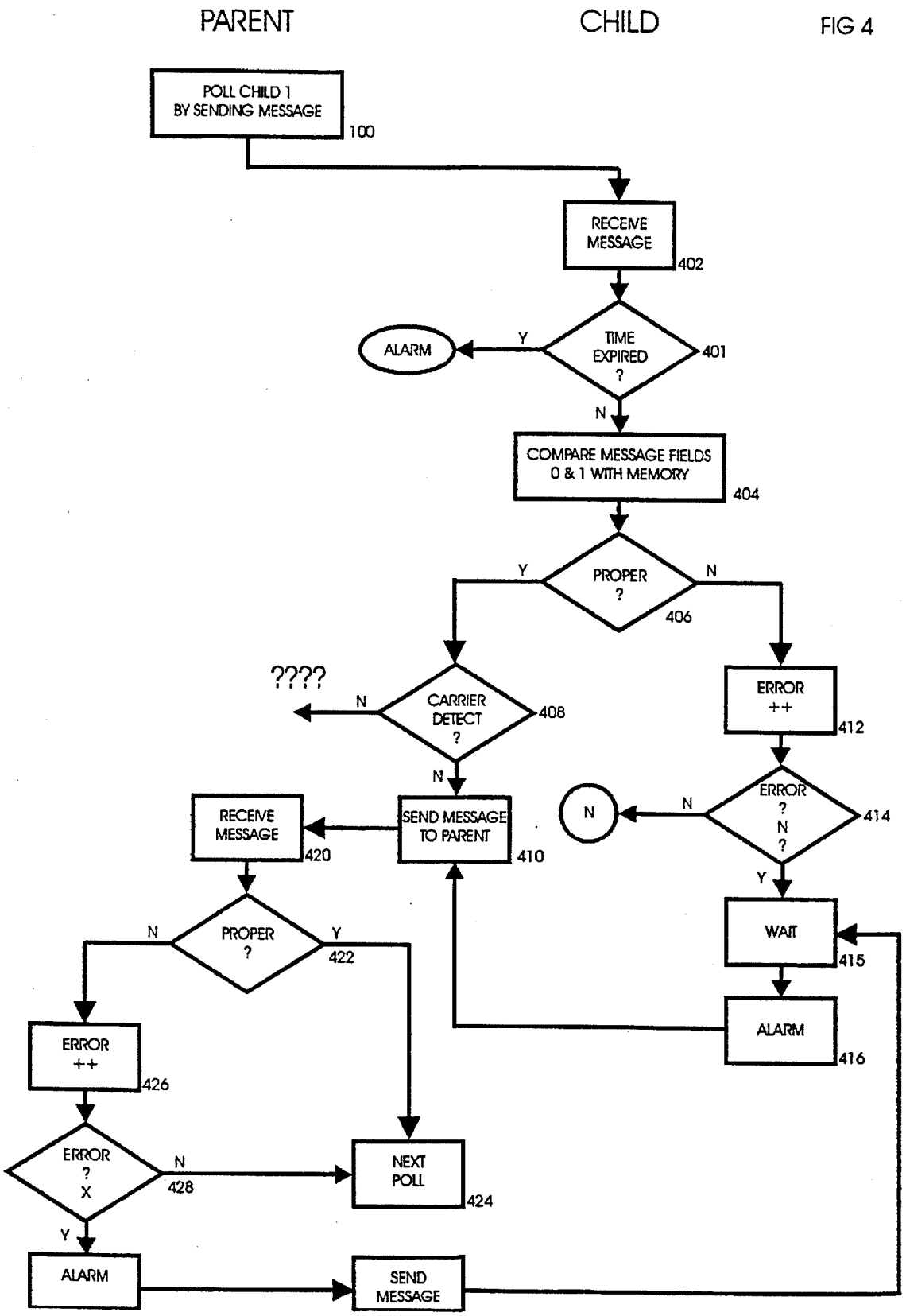
FIG. 4 shows a flowchart of the message polling operation.

The system spends most of its operating time polling from unit to unit. The polling sequence is shown in flowchart form in FIG. 4. It should be understood that the left side of the flowchart represents the parent operations while the right side of the flowchart represents child operations.

At step 400, the parent is polling child 1. As will be described further herein, the parent switches between polling different units at different times. The present invention currently includes the capability of polling eight different child units. The poll is carried out by assembling the FIG. 3 message to include the parent id of the parent from in its EEPROM and the child number for child 1. No message is sent in the command block 3. This message will be properly received by the child unit 100 if the child is within range.

At step 402, the child unit receives the message, and compares the message fields 0 and 1 with those message fields which are stored in its own EEPROM memory. Those numbers in memory identify the child unit's child number, and the parent unit number to which it should respond. Step 401 uses a timer to determine if the child has received its message timely. If the message received by child unit at step 402 matches the value stored in its memory, then the message is determined to be proper at step 406. If so, the child unit waits to see if it is still detecting a carrier from the parent at step 408. Carrier detect is used by the child unit to determine if the parent is still sending. Once no carrier is detected at step 408, the child assembles and sends a message to the parent at step 410. This message again is precisely as used in FIG. 3: the child sends its parent id, its child number, and a command.

If the message received is not proper at step 406, the child increments an error count at step 412. At step 414 the error count is compared against a preset value for example, 3 errors. If the error is greater than this value, an alarm condition is established at step 416.

The error value is used as an indication of range between units. The transmission between units have been found to become more noisy as the distance between these units increases. Accordingly, as the distance increases, the error value increases.

The system of the present invention uses the error count as an indication of the distance between units. It monitors the number of errors received to determine range between the units. When the distance is greater than a predetermined distance, the system establishes an alarm condition which activates a high volume siren 212. The siren can be, for example, a piezoelectric buzzer of the type commonly used in smoke alarms.

Figure 3:
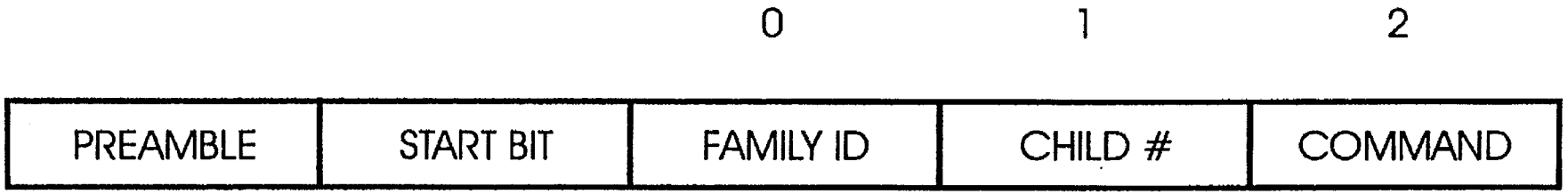
FIG. 3 shows a message layout structure.

The alarm condition also causes a special code to be sent in the command portion 2 of the FIG. 3 message. The parent is presumably out of range and hence not reliably receiving this message at this time. If the parent does receive this message, however, it alarms immediately. The alarm message also allows a central monitoring facility 180, which monitors all transmissions for alarm messages. Any alarm messages can then activate a security alert, and can also monitor the position of the alarming unit, since the central monitoring facility receiving the alarm message will be within 30–50 feet of the alarming unit. This central monitoring facility could be used in amusement parks, shopping malls, or the like.

It should be understood that other techniques could also, less preferably, be used to effect proximity detection. These techniques include, for example, triangulation, global positioning (GPS), and others.

Returning, however, to the condition where everything is working properly, the message has been sent from the child to the parent at step 410 and is received by the parent at step 420. The parent stores a list of authorized child units, and it knows which one it is monitoring. At step 422, the parent compares the message from the child against the information stored in memory 202 to determine if the transmission represents the proper kind of information. If so, the parent continues to the next poll sequence at step 424, to poll the next child in the sequence. Since the parent stores a list of authorized child units and knows which one it is monitoring, it can easily choose the next one on the list to poll.

If the message is not determined to be proper at step 422, the error value is incremented at step 426. If the number of errors is determined to be greater than 3 at step 428, an alarm condition is established at step 430. That alarm condition also adds an alarm message to the command section of the message, thereby sending an alarm condition to the child. If the child detects this message, it alarms at step 416 after delaying in step 415. The delay is used so that the parent unit sounds prior to the child unit. In this way, the parent obtains an early warning of the possible abduction, before the child unit might otherwise inform a would-be abductor.

This preferred operation allows the parent to alarm when the parent unit is separated from the child unit by 30 feet. The child unit will alarm when separated from the parent by 50 feet. The difference in the ranges between the parent and child unit uses a more sensitive aerial at the child for receiving, e.g. a longer antenna.

Figure 5:
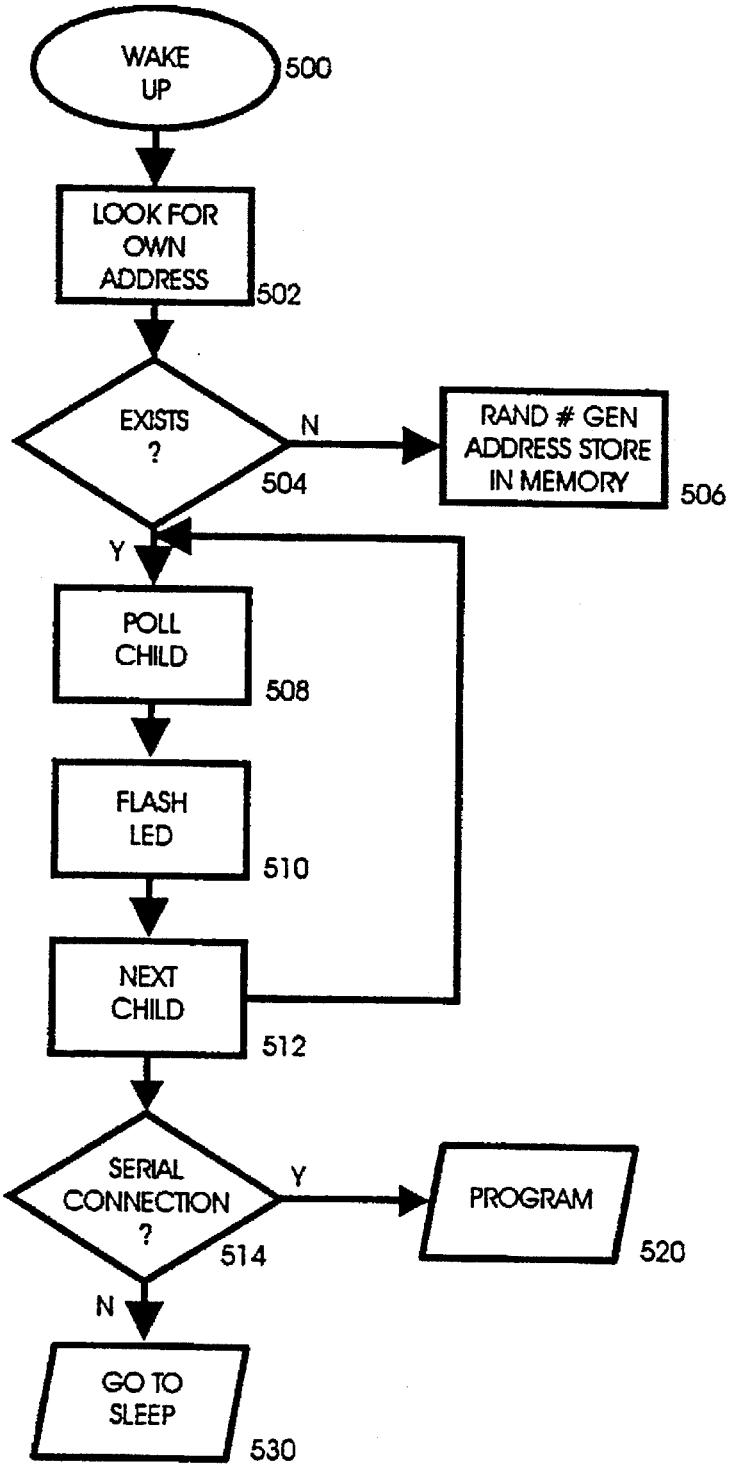
FIG. 5 shows a flowchart of operation of the parent unit.

The above represents the usual operation of the system. A more detailed description of the parent unit system flowchart is shown in FIG. 5. The parent unit normally operates in a watchdog mode in order to conserve battery power. The watchdog timer preferably keeps the parent unit in a sleep mode for 600 ms intervals. The parent wakes up every 600 ms to carry out its polling and other functions.

Step 500 represents wake-up from the 600 ms sleep period of the watchdog timer. When the parent unit initially wakes up, it first attempts to assemble a poll. LED 122 is normally off, but turns on momentarily when each poll is assembled. This causes the LED to flash each time a poll is sent, so the LED flashes once for each child unit being monitored. In order to do this, the parent unit must find its own address, so it first looks in the EEPROM 202 for its own address at step 502. The parent unit determines whether the parent unit's address is present in the EEPROM at step 504.

If not, a parent number is generated. This is preferably effected by a software routine to establish a random number. This random number generator generates a random address and stores it in EEPROM at the addressed location. According to another aspect of the invention, after generating the random number, a reception mode is entered in which the system detects whether there is any interference between other units and that generated number. If so, another number may be generated and stored, that other number preferably not having the same kind of interference.

At step 508, the first child is polled using a message comprising the parent id address, and the address of the child obtained from the child-address memory location of the EEPROM. LED 122 flashes once for each poll to cause the LED to flash a number of times which is dependent on the number of children which are currently programmed into the memory of the parent unit. For example, if two children are programmed to be monitored, the unit flashes twice in quick succession and then remains on.

At step 512, the next child in the sequence is polled.

Step 514 represents a hardware interrupt to determine whether there is a serial connection to the modular phone jacks 110/120. This hardware interrupt can be triggered by, for example, toggling a level on the clock lines. The serial connection with parent unit 120 is detected when button 130 is depressed. If detected, then the system is started in programming mode, and the programming routine is called at step 520. If the programming mode is not detected, the system returns to sleep for 600 ms at step 530.

The detailed operation of the first embodiment of the programming mode is described with reference to the flowchart of FIG. 6.

Figure 6:
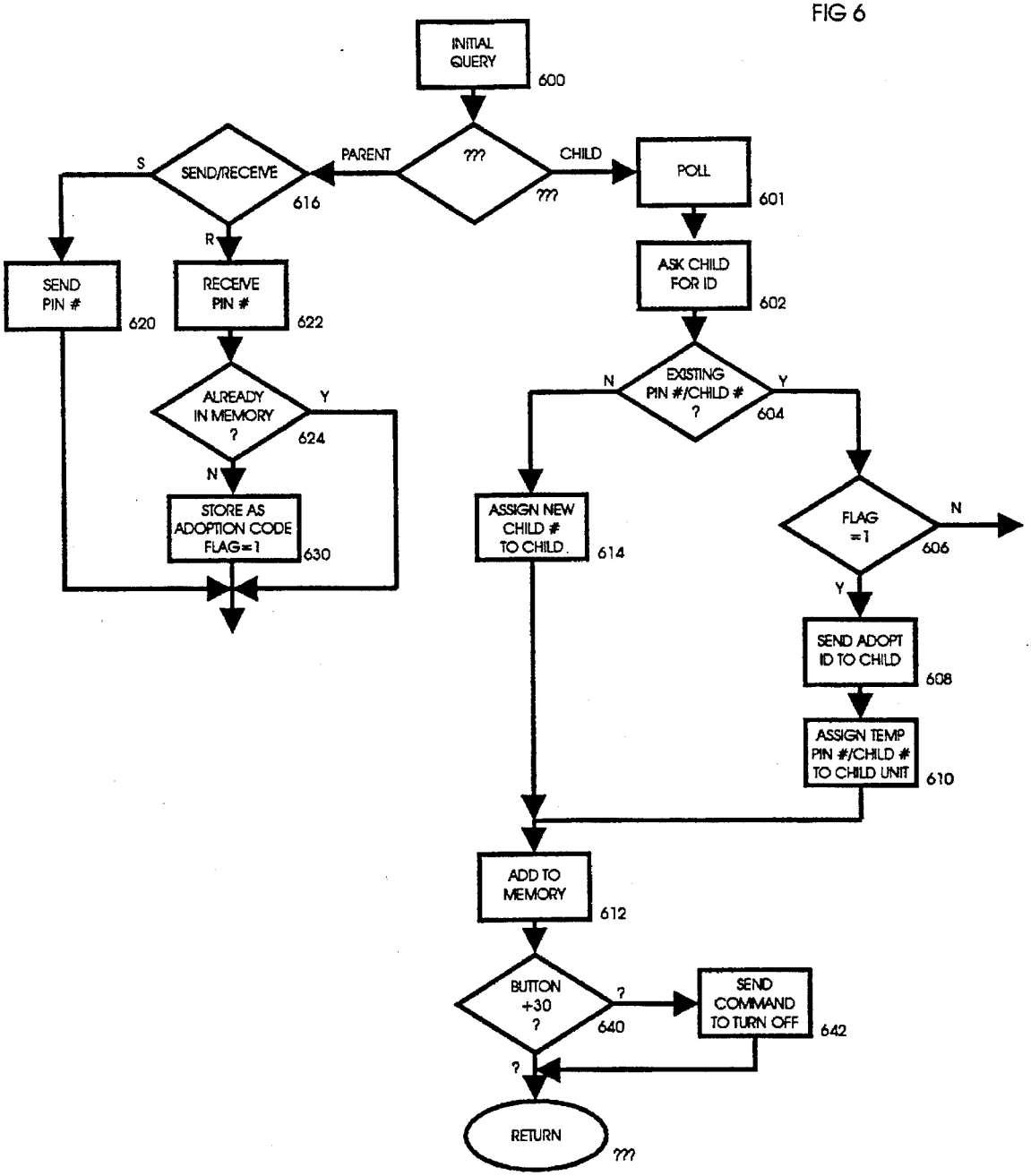
FIG. 6 shows a flowchart of operation of the assignment done by the parent unit.

FIG. 6 illustrates a flowchart of the serial communication between connectors. As stated above, those connectors are preferably modular telephone jacks. The serial communication is preferably effected using a synchronous serial data transmission protocol such as I C or the like. The flow control is under complete control of the parent. Hence, the parent controls the transfer rate and clocking of data.

FIRST EMBODIMENT OF ADOPTION

The first query is sent to the units to detect whether the unit being connected is a parent unit or a child unit. The detection causes a branch between the parent programming and the child programming at step 600.

If the unit is a child unit, then the child unit is polled at step 601. If the child unit is in its off mode at this time, the poll from the parent turns it on. Note that the child unit is never really powered off—it is only really ever in the standby state. Even when the unit is "off", the watchdog timer checks every 600 ms to detect a serial poll.

After turning on, the child unit is asked for its ID number at step 602. The child responds if it has an ID number. At step 604, the unit determines whether the child has an existing parent number and child number therein. This would be stored in a particular location in the child EEPROM. If so, then the child unit has already been programmed. The system then detects if this "flag" has been set. The flag is only set when the parent unit currently communicating has been given an adoption code by another parent unit. Therefore, if the flag is not set, the flow continues. If the flag is set, however, the parent sends its adopt ID, to be stored in an adopt area of the child memory, to the child. The child recognizes this ID and responds. The parent unit at step 610 then sends a temporary child number to the child unit. This adopt code is stored in non-volatile memory in the child unit so that the information is lost at the next power down. The child unit will thereafter respond to polls that include this number, and this information is added into the parent unit memory at step 612.

If there is no existing parent number/child number in the child unit at step 604, then a new child number is assigned at step 614. This is assigned by finding the next available child number in the parent unit memory. The child number information is stored in memory as a series of "0"s. When a child number is assigned, the initial bit is reset to a "1". If the last child unit was unit number "1 . . 00", then the next child unit is set as unit number one. Thereafter, all polls will include the child number "1 . . . 01".

At step 640, the parent unit detects whether button 130 is depressed. If so, then the programming sequence is commanding turn-off of the child. Accordingly, a command to turn off the child is sent at step 642. The sequence then ends.

If, at step 600, the parent unit determines that it is communicating with another parent unit (which we will call parent number 2), the child unit determines whether button 130 is pressed at step 616. If so, the adoptive parent number at step 620. This parent number is sent to the other unit to be stored in the other unit's adoptive memory. Thereafter, the other unit will be able to control child units that are programmed with the adoptive unit number.

If the button 130 has not been pressed at step 616, then the parent unit is the unit to receive the information instead of the unit sending the information. Therefore, the unit receives the other parent number at step 622. This initiates the adoption proceeding whereby a parent unit sets the capability of "adopting" children of other parents. This is useful, for example, if a child is to go somewhere with another parent. In this case, the two parents can connect their units. One parent unit thereby obtains the ability to adopt the children of the other. Thereafter, the adopting parent can program the adopted child unit to receive temporary numbers, as previously described. The adoptive ID thereafter remains in the EEPROM until it is replaced by another adoptive unit number. Therefore, step 624 determines whether the parent number of parent 2 is already in memory. If so, then this communication is a removed step, and the information is removed at step 626 followed by a special flag being set to zero. If the information is not already in memory, however, the information is added to memory at step 630 followed by the flag being set to one.

The child unit operates according to a somewhat different flowchart. The child unit also uses the watchdog timer within its PIC microprocessor to spend most of its time in sleep mode. The child unit, however, must synchronize its wake-up times with those of the parent.

Figure 7:
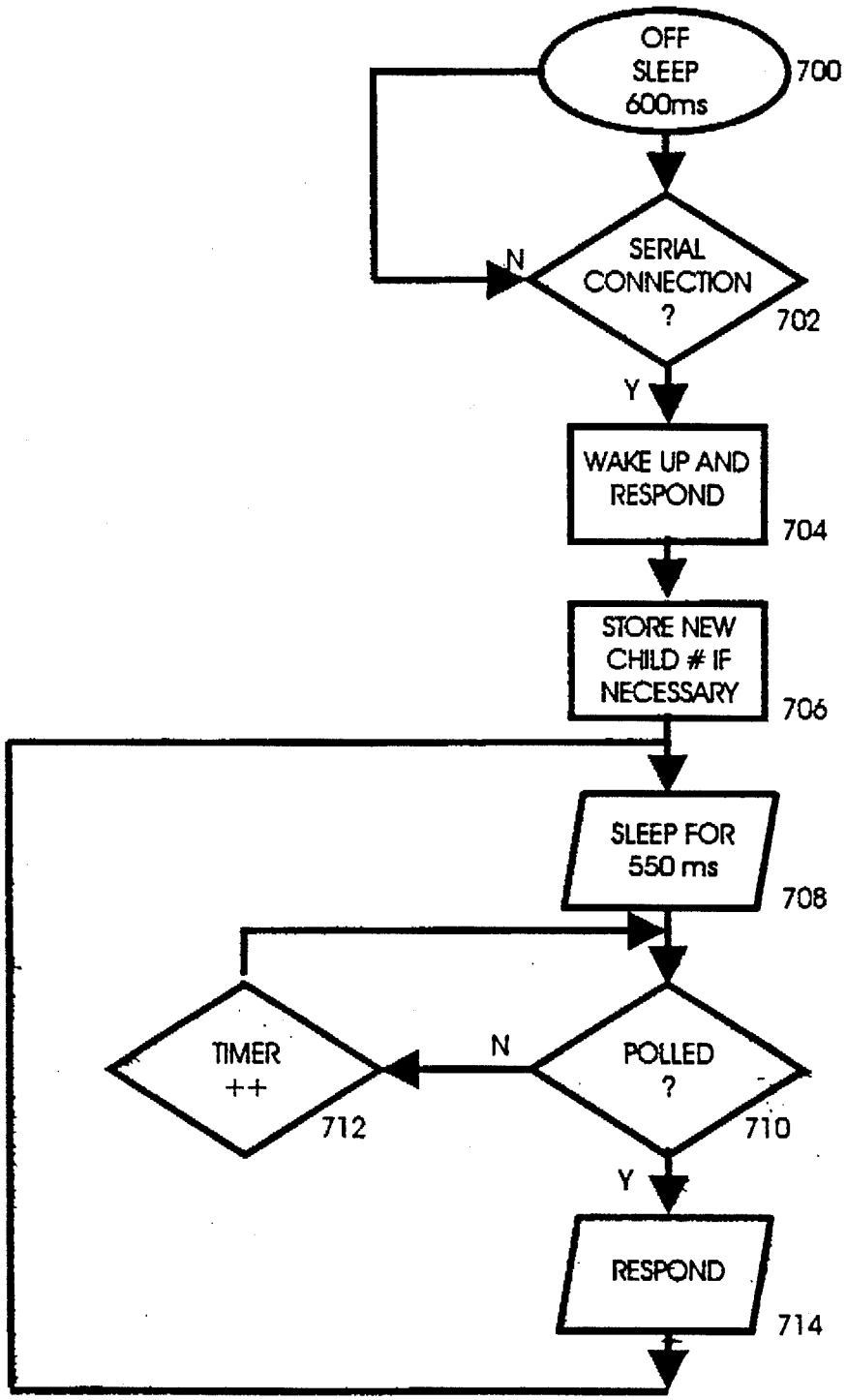
FIG. 7 shows a flowchart of operation of the child unit.

The FIG. 7 flowchart which corresponds to the overall flowchart carried out by a child unit.

When "off", the child unit is still monitoring, with the watchdog timer waking it up every 600 ms to determine if there is a serial connection. Step 700 represents the sleep state, where the serial connection is detected at step 702. If there is a serial connection, then the child unit wakes up and responds to the serial connection according to the kind of poll requested therefrom. This is described in the FIG. 6 flowchart. If there is an adoption proceeding, or a new child number is necessary, then the child number stores it if the request comes from an authorized parent. After responding in this way, the child unit again enters sleep mode for 550 ms at step 708. This sleep period is about 50 ms less than the sleep mode entered by the parent unit. The child unit must be awake when the parent unit sends its poll, and hence the sleep mode must be for some amount of time less than the sleep mode in the parent.

After waking up at the end of step 708, the child unit waits for a poll at step 710. A timer is also initiated to ensure be sure that the child unit does not wait so long that an error set be established. The timer of step 712 counts to, say 800 ms, and then establishes an error.

If a poll is detected at step 710, the unit responds at step 714 as described earlier.

A second embodiment of the invention takes a different tactic for adoption. As discussed above, the original idea of adoption is that the child stores its name forever once it has been christened. As explained, it will accept a temporary name for a short time for adoption. The only problem with this scheme is what happens when a parent becomes unavailable for use—e.g., it is lost or damaged. In this scenario, all of the child units become useless. The alternate scheme for adoption, now preferred, is that the child unit can accept any name if it is powered up starting from an "off" condition. Therefore, any parent can control any child provided that child has been turned off by its previous authorized parent unit. However, only the parent that turns on the child may turn off the child. However, as long as the authorized parent turns off the child (and we assume that most of the time the child unit is turned off), then the parent can toggle the clock line each time through the main loop after coming out of sleep. The child unit, if attached, would see the clock line change level and use that as the source of an interrupt.

In this way, units connected together are automatically turned on and off, and naming occurs automatically without any need for an actuation such as a button being pressed.

Figure 8:
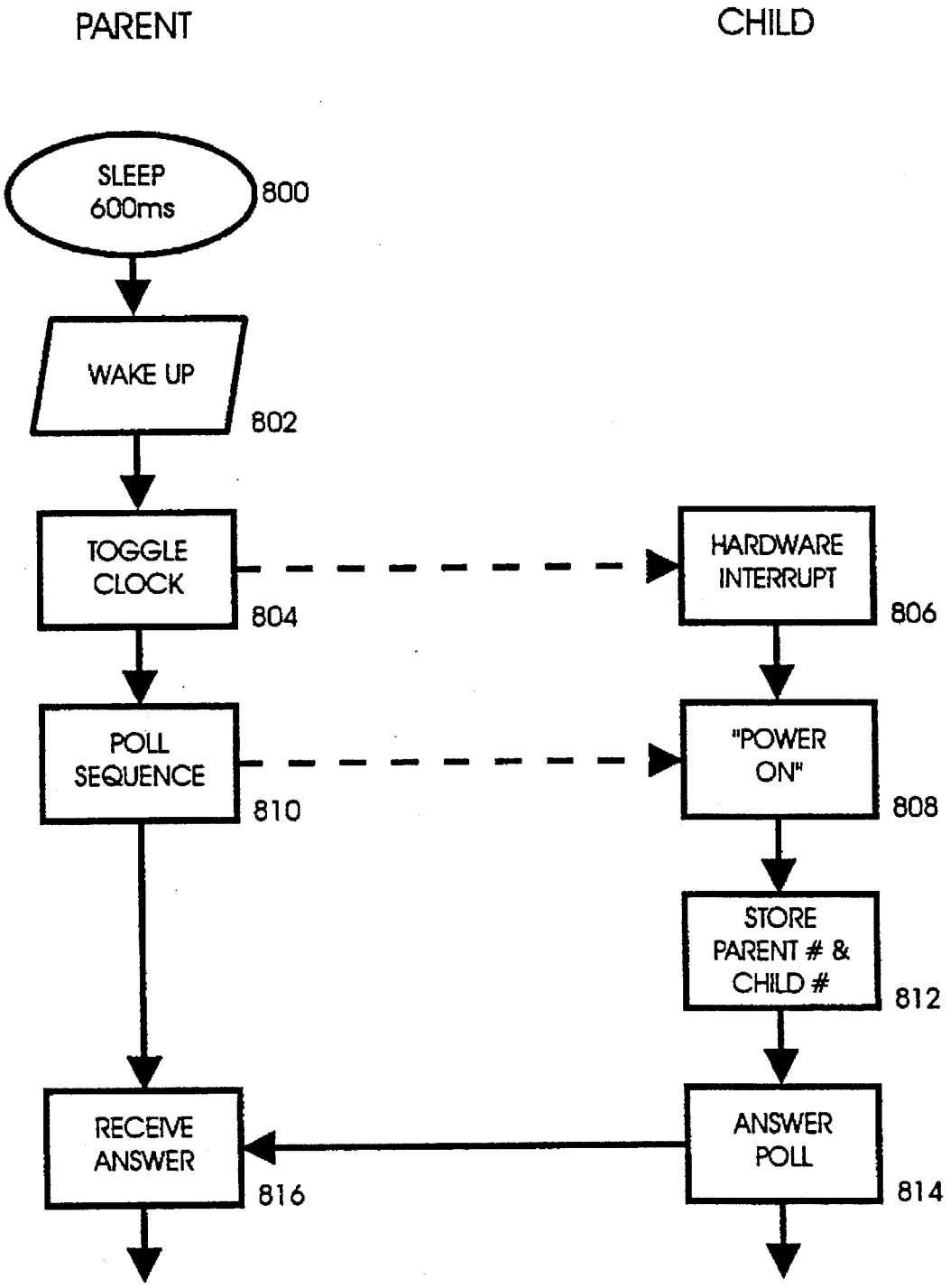
FIG. 8 shows an alternate operation of adoption according to the present invention.

The flow routine for this modified technique is shown in FIG. 8. The parent unit, as described above, sleeps for most of the time, and a watchdog timer wakes up the parent unit at step 800. After waking up at step 802, the parent unit toggles the clock line at step 804. If the parent unit is at that time connected to a child unit, the toggle on the clock line causes a hardware interrupt at step 806. That hardware interrupt at step 806 causes the child to "power on" and begin answering polls.

Upon powering on, the child unit recognizes a poll sequence 810 from the parent. It receives the information from poll sequence 810, and stores the parent number and the child number received from the poll sequence at step 812. The child unit answers the poll at step 814 with the FIG. 3 message, including its new addresses therein. The parent receives the answer at step 816, indicating that all action has occurred properly.

Although only a few embodiments have been described in detail above, it will certainly be understood that many modifications are possible in the preferred embodiment without departing from the teachings thereof.

All such modifications are intended to be encompassed within the following claims.

What is claimed is:

1. A proximity detector comprising:

a first transceiver unit, configured to have a parent identification number; and a second transceiver unit configured to have a child identification number;

said first transceiver unit including a message producing structure which produces a polling message which includes identification numbers therein to the second transceiver unit, and which monitors responses from said second transceiver unit to determine if said second transducer unit is further than a predetermined distance therefrom to produce an alarm;

said second transceiver unit including a processor which investigates said polling message to determine if said polling message includes a parent identification number and a child identification number which each match a predetermined criteria, and transmitting a response only if so, and wherein said second transceiver unit also includes an element for detecting that said first transceiver unit is more than a second predetermined distance therefrom, and producing an alarm based on said detecting.

* * * * *